United States Patent [19]

Waterman et al.

[11] 4,295,427

[45] Oct. 20, 1981

[54] CAR REPAIR APPARATUS

[75] Inventors: Fred W. Waterman, Daly City; Jerry E. McCleery, San Francisco, both of Calif.; Robert T. McKie, Boise, Id.

[73] Assignees: Morrison-Knudsen Co., Inc., Boise, Id.; Railcar Maint. Co., San Francisco, Calif.

[21] Appl. No.: 110,568

[22] Filed: Jan. 9, 1980

Related U.S. Application Data

[63] Continuation of Ser. No. 895,685, Apr. 12, 1978, abandoned.

[51] Int. Cl.[3] ..... B61K 5/00

[52] U.S. Cl. ..... 104/32 R; 414/366; 414/678; 414/786

[58] Field of Search ..... 414/354, 359, 360, 361, 414/364, 366, 371, 372, 678, 771, 779, 783, 786; 104/32 R, 32 A, 122; 29/401 F, 468

[56] References Cited

U.S. PATENT DOCUMENTS

| | | | |
|---|---|---|---|
| 1,280,531 | 10/1918 | Pattison | 414/366 |
| 1,283,656 | 11/1918 | Burke | 414/678 |
| 1,341,501 | 5/1920 | Earley et al. | 104/32 R |
| 2,260,623 | 10/1941 | Holmes | 104/32 R |
| 2,716,949 | 9/1955 | Converse | 104/32 R |
| 3,583,335 | 6/1971 | Schilf et al. | 414/360 X |

FOREIGN PATENT DOCUMENTS

| | | | |
|---|---|---|---|
| 342720 | 10/1921 | Fed. Rep. of Germany | 414/360 |
| 349526 | 3/1922 | Fed. Rep. of Germany | 414/360 |

*Primary Examiner*—Leslie J. Paperner

*Attorney, Agent, or Firm*—Townsend and Townsend

[57] ABSTRACT

A car repair station is disclosed having sequential way stations along a continuous track for the assemblyline repair of railroad cars, preferably of the Hopper type. The car passes into and under paired gantries at a second way station. These paired gantries are positioned at each end of the car and include a vertically moveable, horizontal lifting beam which moves up and down the gantry. The lifting beams have protruding therefrom a bell crank. When the bell cranks fasten to the coupler pockets and additional fastening is made to other portions of the car body the car is lifted by raising of the lifting beams and rotated about a longitudinal axis which is substantially coincident with its center of gravity. The car trucks are wheeled away through a turntable system, and the car is rotated on its side and lowered to two platforms with the gantry cranes, horizontal lifting beam, and bell cranks releasing the car. The car is then conveyed to a subrepair station on either side of the second way station where repair to the car underbody can be accomplished. Once repaired, the rotating procedure is reversed and the car is placed on refurbished trucks. Upon placement to the refurbished truck, the car is conveyed to a third way station for coupler replacement, draft gear replacement, brake reconnection and safety appliance repair.

3 Claims, 9 Drawing Figures

CAR REPAIR APPARATUS

This is a continuation, of application Ser. No. 895,685, filed Apr. 12, 1978, abandoned.

This invention relates to an apparatus for repairing railroad cars, and more particularly, for the assembly-line repair of unit train cars.

STATEMENT OF THE PROBLEM

Unit trains are now in use. Typically, such unit trains comprise long lines (of about 100) ore or fuel gondola cars coupled together in semi-permanent units. In use these cars are loaded at a mine, make a trip to an unloading destination, and then return to the mine. As compared to conventional railroading, cars in such unit trains accumulate high over-the-road mileage. Because of this high over-the-road mileage, relatively frequent repair is required, typically at intervals ranging from 20 to 24 months.

In order to satisfactorily service a unit car railroad operation a spare car inventory is required. Typically, this spare car inventory is on the order of 10%. Thus, when cars are damaged or out for repair, a constant number of cars can remain for unit train service. This constant number assures the volume flow of either ore or fuel required to be transported by the railroad.

SUMMARY OF THE PRIOR ART

Repair of such unit train cars is now typically accomplished in shops where each car is disassembled, repaired and reassembled at a single way station. Assembly-line techniques of repair have generally not been adopted.

Moreover, such repairs stations are not balanced with respect to the time required to work on and repair such ore carrying unit train cars. Instead, single repair stations are used, at which single repair stations all car repair functions occur.

It is known to rotate cars for repair. Typically, such rotation occurs from the upright car position to either a 90° on-the-side position or a completly inverted position. This rotation is typically accomplished by pendulously supported rotating mechanisms. These mechanisms are not without their diffuculty in that the car inevitably sways when it is lifted and rotated. Moreover, the car support and rotating mechanism is usually tied up during the entire time of car repair. Heretofore, no provision has been made to free a car lifting and rotating mechanism during repair.

Finally, pendulously supported lifting and rotating mechanisms have difficulty or registry of the car to the railroad car trucks when the car is reassembled. Considerable time is spent stopping the sway of the suspended car and registering the car to the underlying trucks.

SUMMARY OF THE INVENTION

A car repair station is disclosed having sequential way stations along a continuous track for the assembly-line repair of railroad cars, preferably of the Hopper type. After brake disconnection, coupler removal, and minor bodyside repair (with possible draft gear removal) at a first way station, the car passes into and under paired gantries at a second way station. These paired gantries are positioned at each end of the car when it is stopped at the second way station. Each gantry bridges the continuous track and includes a vertically moveable, horizontal lifting beam which moves up and down the opposite sides of the gantry. Each gantry is freely moveable, so that the gantries with their horizontal lifting beams lowered can confront the car at each end. When the beams are lowered, the lifting beam has at the medial portion protruding therefrom a bell crank. This bell crank is mounted at a center of rotation to the horizontal lifting beam and extends eccentrically from the center of rotation to a protruding male member which fits within the female concavity defined by the empty coupler pockets of the car body being lifted. When the bell cranks fasten to the coupler pockets and additional fastening is made to other portions of the car body—as by chains to the side rails of the car body—, the car is lifted by raising of the lifting beams. The car trucks fall clear and are wheeled away through a turntable system. The car is rotated about the center of rotation with the eccentricity of the bell crank coinciding with car rotation about a longitudinal axis coincident to the center of gravity of the car. Once the car is rotated (preferably 90°), it is laid on its side and lowered to two platforms with the gantry cranes, horizontal lifting beam, and bell cranks releasing the car. The car is then conveyed to a subrepair way station on either side of the second way station where repair to the car underbody can be accomplished with all welding being to vertical surfaces. Upon completion of repair at the substation, the car is returned, grasped by the gantries, and rotated to the upright position and placed on typically refurbished trucks wheeled in under the car. Upon placement to the refurbished trucks, the car is conveyed to a third way station for coupler replacement, draft gear replacement, brake reconnection and safety appliance repair. Inspection at a fourth way station follows with appropriate followup repairs before the car passes out of the disclosed car repair station.

OTHER OBJECTS AND ADVANTAGES

An object of this invention is to disclose a car repair station assemblyline having discrete way stations in which car repair is accomplished on similar units of a unit train in assemblyline fashion. A series of four way stations is disclosed, all comprising stops along a continuous track. The first way station includes the functions of brake disconnection, coupler removal and minor bodyside repair (with car draft gear removal being optional). This station frees the car trucks, so that the car body can be lifted free of the trucks. A second way station includes the car passing under paired gantries. These gantries, at a moveable lifting beam and coupler pocket engaging bell crank, lift the car body with the trucks remaining free. Typically, the trucks are wheeled away to a truck repair shop, and the car rotated on its side. Once the car is rotated to its side, first and second platforms receive the car on its side, and disengagement from the rotating gantries occurs. The car then is moved to one side or the other side of the second way station. Repair of the car underbody occurs. Upon completion of underbody repair, the car is placed between the gantry, lifted and rotated to the vertical position and registered to refurbished trucks. The gantry is then raised and the car passed to the third way station. At the third way station brake reconnection, coupler replacement (preceded by draft gear replacement, if applicable), and safety gear replacement occurs. Finally, the car proceeds to a fourth way station at which inspection and followup repair occurs.

An advantage of the invention is that the individual car units of a unit train are repaired on an assemblyline basis. Specialized machines and repair specialists await each car at each station. Car repair is greatly expedited.

Another advantage of this invention is that the bottom side of the car is repaired by vertical welding. Much time is saved in the placement of weldament, the overhead placing of weldament being completely avoided.

Yet another advantage is that the required car inventory necessary as spares can be effectively repaired while still acting as spares. Since the cars, repaired on an assemblyline basis, have an average trip of approximately five hours through the disclosed repair station, they are not effectively removed from their "main line" readiness condition.

Another object of this invention is to disclose an apparatus for facilitating car underbody repair, such as replacement of bolsters and pressure plates. According to this aspect of the invention, the second way station includes an entry and exit track along which the car enters the station. Paired gantries at either end of the station are amounted for rolling and free movement upon respective paired tracks which straddle car entry and exit track. Paired lifting beams extending across the gantries climb at points of attachment to the vertical sides of the gantry up and down the gantries. Medially of the horizontal beam there is a bell shaped crank which rotates at the medial portion of the crank and extends into the female concavity of the car coupler pockets at a male eccentric member. Once the car is rolling between the gantries, the horizontal beam is lowered and the male eccentric of the bell cranks registered to the coupler pockets. After tying of the car ends to the bell crank (as by chain ratchet mechanisms) the car is lifted, the trucks remain on the track and are wheeled away. Thereafter the car is rotated 90° and lowered to paired platforms which wheel the car body to one side or the other side of the repair station.

An advantage of this apparatus of the invention is that cars of varying length can easily be accommodated.

A further advantage of this invention is that pendulous movement of the car is completly avoided. Removal of the car from the car trucks, and more importanly registration of the car to refurbished car trucks, is greatly facilitated.

Yet another advantage of this invention is that when the car is initially raised, the trucks can be easily removed. Specifically, they can be wheeled by hand to a truck turntable. By the provision of making one track route for truck removal and another track route for truck replacement, a continuous flow of trucks to be repaired and trucks refrubished for mounting to repaired car bodies can occur.

Yet another advantage of the platforms utilized with the turning mechanism of this invention is that first and second repair stations can be defined on either side of the rotating mechanism. Since underbody repair normally consumes twice the interval of repair at other way stations, the station easily accommodates the remaining way stations disclosed in the present invention.

Yet another advantage of this invention is that the car rotation and moving is done with a minimum of personnel.

Other objects, features of this invention will be more apparent after referring to the following specification and attached drawings in which:

FIG. 1 is a perspective view of the railcar repair station of this invention, illustrating sequentially the four way stations of this invention;

FIG. 2 a perspective of the second way station illustrating the car after it has moved into position between the two bridging gantries with the horizontal lifting beam in the raised position to clear the car;

Figure 1:
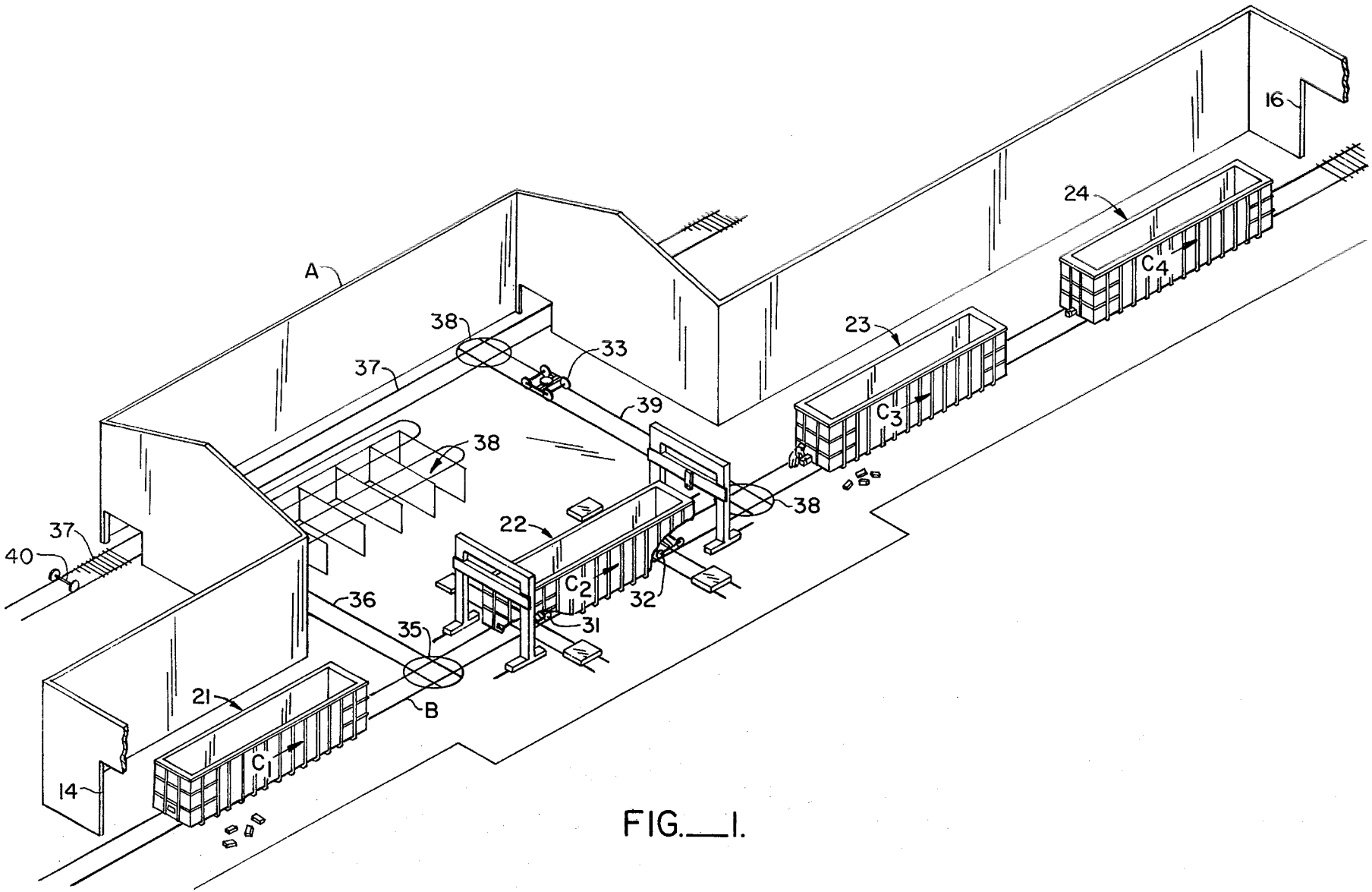

Referring to FIG. 1, a perspective view of the car repair station is illustrated. Typically, the car repair station illustrated is an all weather facility. Therefore, it is enclosed within building A. Running the full length of building A is track B. Track B enters building A through door 14 and departs building B through door 16. In between the entrance 14 and the exit 16 there are four separate way stations 21–24.

Describing the stations sequentially, car $C_1$ at way station 21 undergoes brake disconnection, coupler removal and minor bodyside repair. It is optional, but not always required, that draft gear removal can occur at way station 21.

Way station 22 is the car body lifting and rotating station. Typically, at way station 21 the car has been prepared, so that the car body when lifted and rotated has its trucks 31, 32 remaining on track B. The trucks on track B are wheeled away via track B, truck turntable 35 and adjoining trackage 36, 37. A truck disassembly station 38 is illustrated. It includes an overhead monorail system which facilitates disassembly of the trucks and removal of the wheel sets 40 to a wheel shop for repair.

When repair of car $C_2$ is completed at way station 22, new or refurbished trucks 33 are passed via truck turntables 38 and track 39 to track B for placement directly under refurbished cars $C_2$. Once these trucks are precisely positioned on track B, car $C_2$ is lowered onto the trucks and conveyed to way station 23.

At way station 23 brake connection occurs, couplers are replaced, and safety gear repaired. Optionally, draft gear can be replaced where it has previously been removed at way station 21.

At way station 24 inspection and followup repair occurs. Discharge of the car from the car station follows thereafter. It is of interest to note that at way station 24 the commonly required test of the car and associated braking system occurs. In the industry this is referred to as "ITDS", which stands for the words Initial Test Date and Stencil.

Having set forth the general progression of cars through the facility, detailed attention can now be devoted to way station 22.

Referring to FIGS. 2-6, a cartoon series is illustrated which shows car repair way station 22. For convenience, the overall parts of the way station will be described in FIG. 6; thereafter the operating sequence will be described beginning with FIG. 2.

Way station 22 has track B running longitudinally therethrough. Straddling track B at each end of the way station are paired gantries $G_1$ and $G_2$.

Gantries $G_1$ and $G_2$ ride on respective tracks 51, 52 and are capable of movement towards and away from the respective car ends. They are of sufficient strength, so that they may support the car. They each include two vertical members 61, 62 and a horizontal beam 63. Thus, they are provided with the typical inverted "U" configuration common to railroad gantries. Gantries $G_1$ and $G_2$ are mounted on wheel sets which permit gantry movement substantially parallel to track B.

Each of the vertical side members 61, 62 of the gantries G has fastened thereto a lifting beam H. Beam H is capable of upward and downward movement by means of screw jacks (later to be described).

Each of these horizontal beams H support a rotating bell crank R in the horizontal beam H. As will hereinafter be described, rotating bell crank R is eccentric. It includes an eccentric member which couples into the empty coupler pocket of the car. At its center of rotation the bell crank rotates the car body about an approximate longitudinal axis coincident to the center of gravity of each of the cars. Thus, the eccentric of the bell crank permits rotation of the cars without the necessity of overcoming substantial moments due to non-coincidence of the center of gravity with the longitudinal axis of rotation of the car body as it is lifted.

Track B is intersected by paired tracks 67, 68. These tracks in turn support respective rolling platforms 70, 72 (in the foreground of FIG. 6) and respective platforms 71, 73 in the background of FIG. 6. These respective platforms 71-74 roll to a position of registration substantially overlying track B, receive cars when they are rotated to their side position, and thereafter transport the cars away from between the opposed gantries G. It can easily be seen with respect to FIG. 6 that when this is done, either car $C_2$ or car $C_2'$ can be moved into position, rotated without interference with the remaining car.

Having set forth the description of the gross working parts of way station 22, its operation may now be described with respective FIGS. 2-5.

Figure 2:
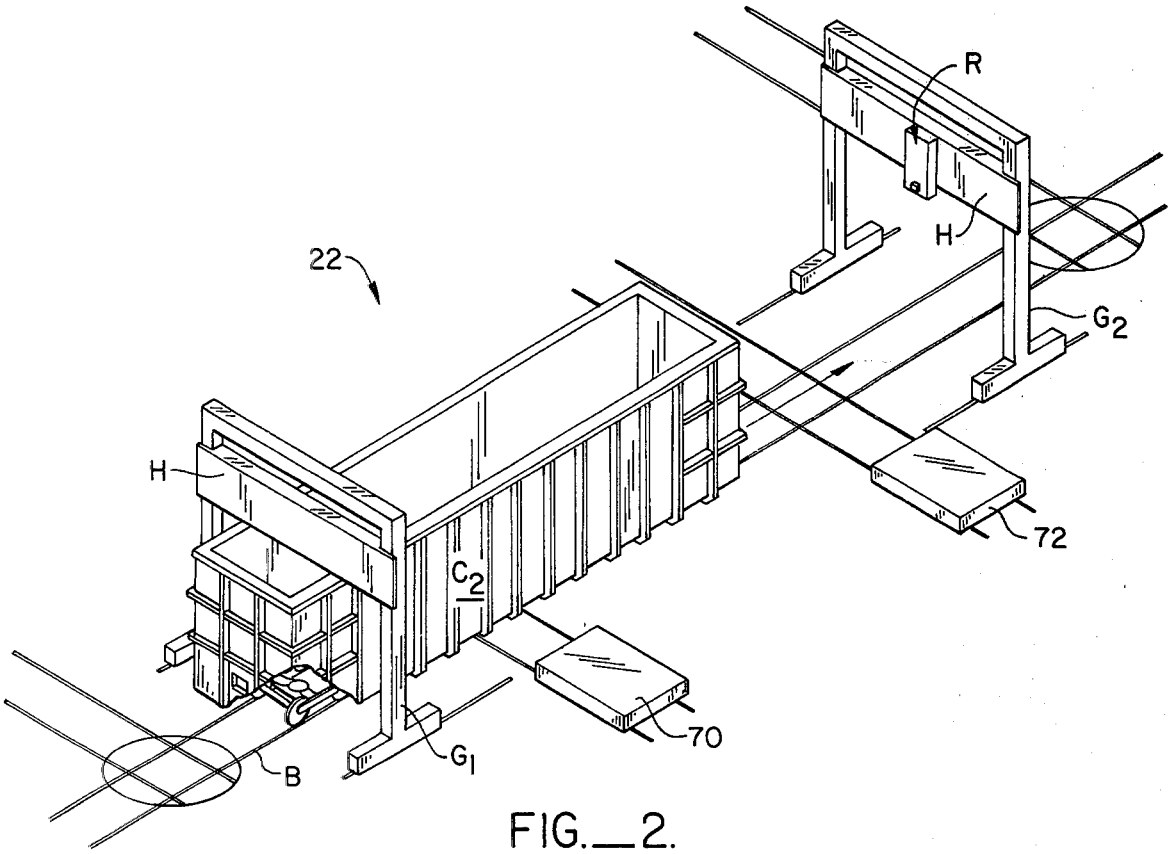
Figure 3:
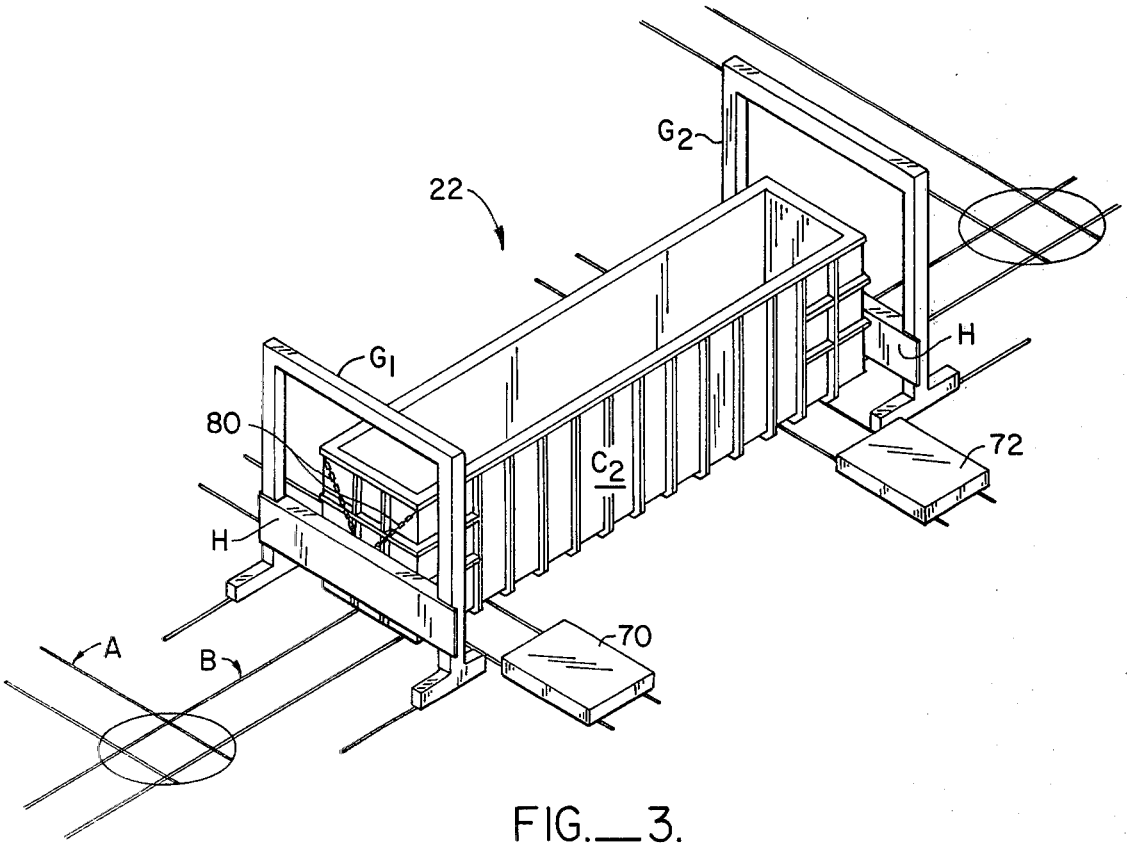
FIG. 3 is a view similar to FIG. 2 showing the horizontal lifting beam on each gantry lowered into car end confronting position and the gantry wheeled forward to confront the car with the bell crank eccentric member in the coupler pockets.

Referring to FIG. 2, each of the gantries $G_1$ and $G_2$ is shown moved parallel to track B away from a medial position with respect to way station 22. The distance between gantries $G_1$, $G_2$ is greater than the length of the railroad car body to be lifted and rotated. The horizontal beams H have each moved to the full upward position, so that car $C_2$ can pass thereunder. This can be seen in FIG. 2. Car $C_2$ is passing under beam H on gantry $G_1$. It will be seen that the rotating bell crank R is well above the car so that there is no interference therewith.

Referring to FIG. 2, the car is medially positioned within way station 22. Gantries $G_1$ and $G_2$ have been rotated inwardly, so that the rotating bele crank R confronts each of the cars at their respective coupler pockets. Chains 80 are connected from the rotating bell crank R to the car ends, so that secure fastening of the car to the rotating bell cranks occurs. In this configuration, the car is ready for lifting and rotation.

Figure 4:
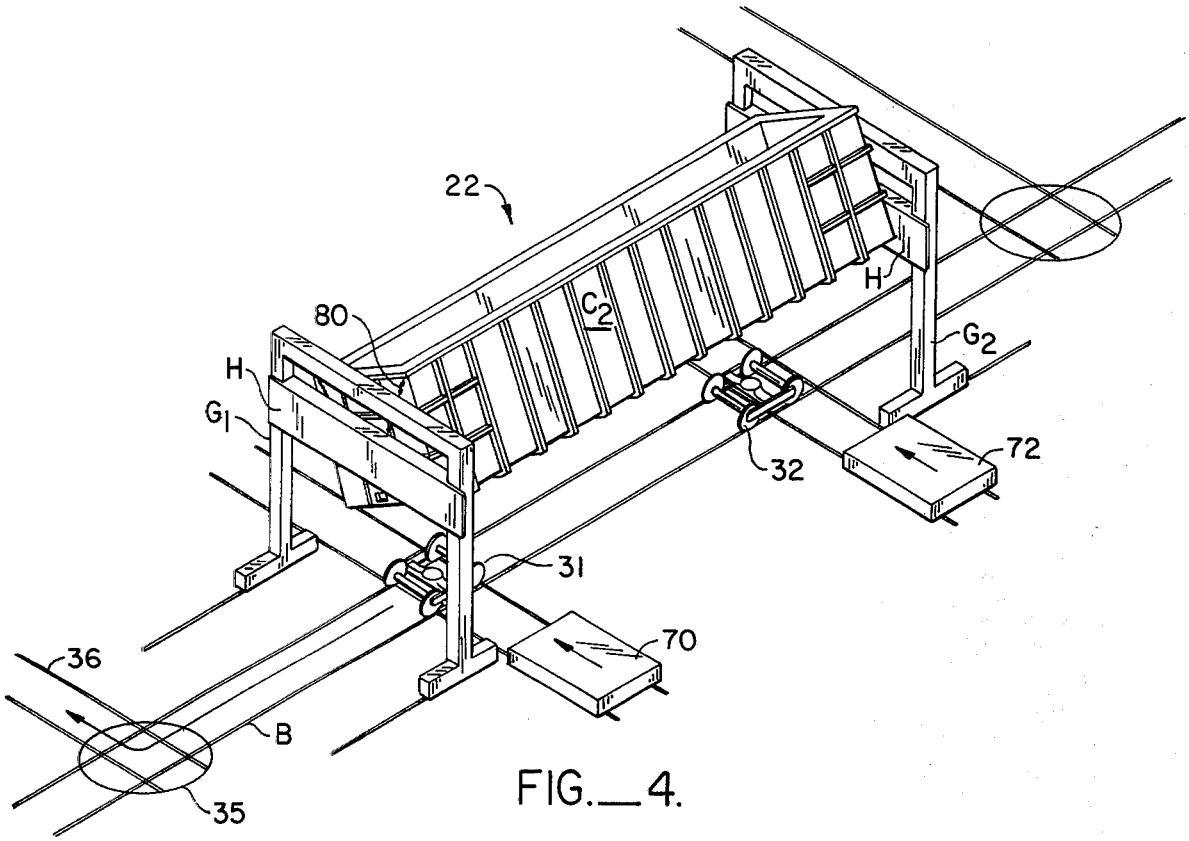
FIG. 4 is a view similar to FIG. 3 showing the car raised, the trucks remaining on the track and rotation slowing occurring (the trucks not as of yet being wheeled away)

Referring to FIG. 4, horizontal beam H has moved upwardly from the respective gantries. Trucks 31, 32 remain on track B. Rotation by the eccentric bell crank R (not shown) is beginning to occur.

At this juncture, two separate steps occur. First, the respective trucks 31, 32 are wheeled to truck turntable 35, turned, and thence wheeled out track 36 to truck refurbishing shop 38. Secondly, the paired platforms 70 and 72 are wheeled into place, preferably by motor drives, so that they occupy on track B a space similar to that previously occupied by trucks 31, 32.

Figure 5:
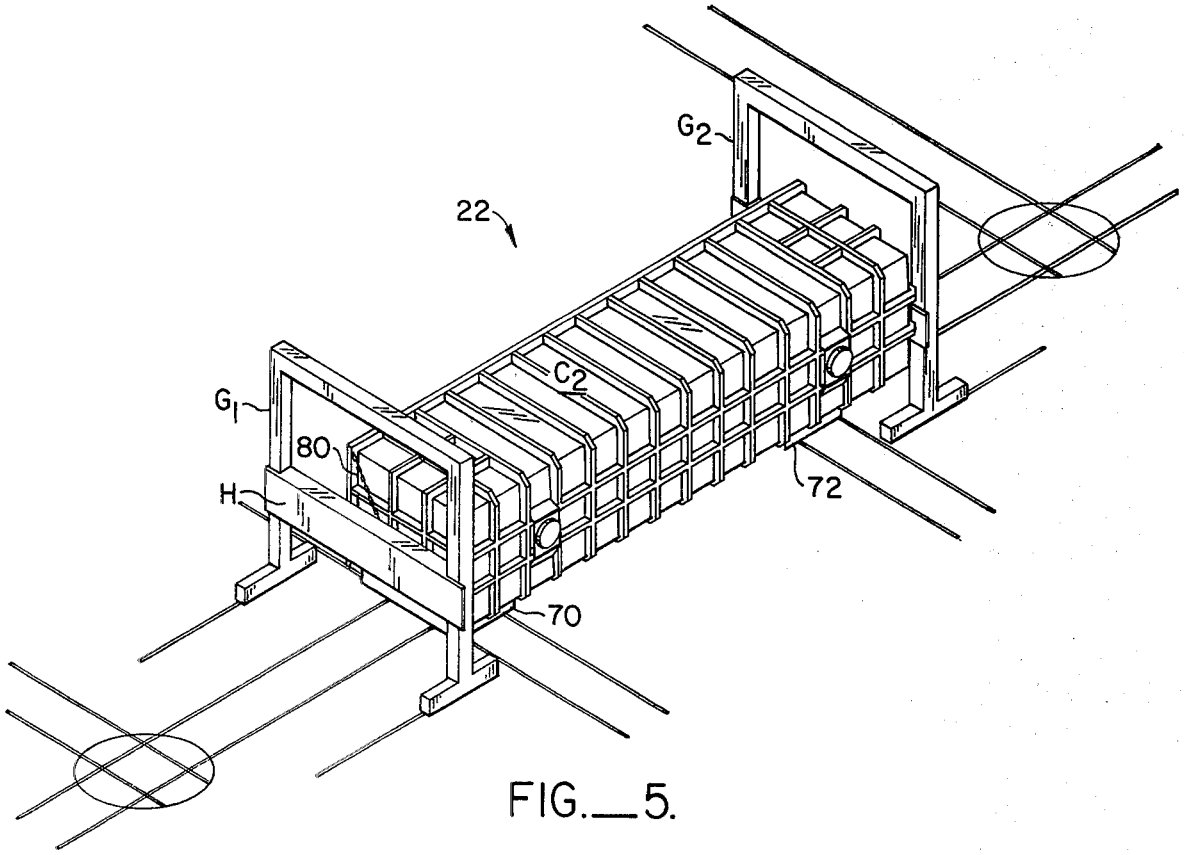
FIG. 5 is a view similar to FIG. 4 and illustrates paired platforms moved in under the car and the car rotated to its side.

Referring to FIG. 5, car $C_2$ has been rotated on its side. Platform 70 and 72 receive the full weight of the car as it lies on its side. Thereafter, chain 80 can be disconnected, gantries $G_1$ and $G_2$ removed from the car sides, and car $C_2$ moved to the position shown in FIG. 6.

Figure 6:
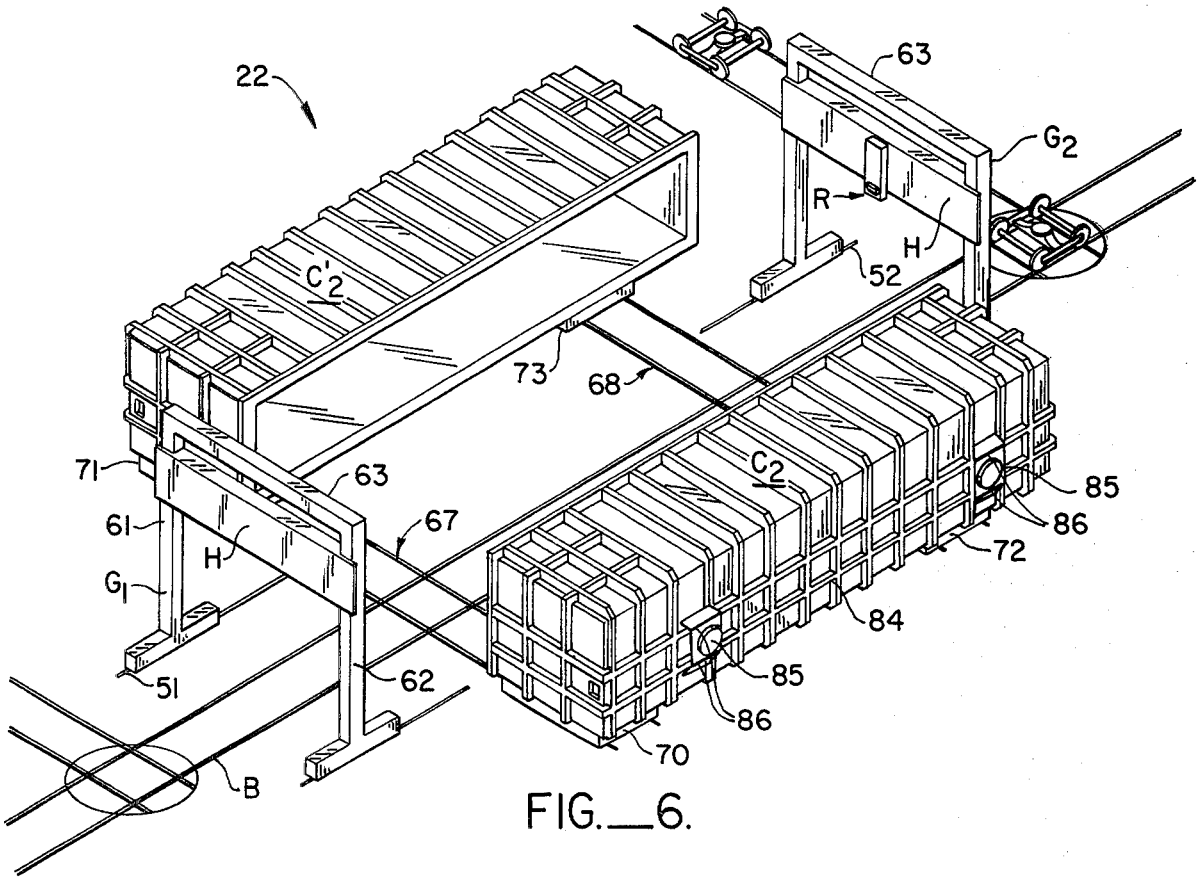
FIG. 6 is a view similar to FIG. 5 and shows the repair station with one car on each side for undergoing repairs.

Referring to FIG. 6, it will be noted that the underbody 84 comprises a vertical surface. Repair of wear plates 85 and bolster mechanisms 86 can easily occur, all by vertical welding. Moreover, it will be seen that the lifting and rotating gantries are free while such repair occurs. Thus, it can be readily seen that while car $C_2$ is being repaired, car $C_2'$ can be moved in between the gantries. By the simple expedient of reversing the process just recited, car $C_2'$ can be lifted, rotated to the vertical position, registered to trucks brought underneath the car, and finally released by the gantry mechanism. When release occurs the car $C_2'$ is conveyed to way station 23.

Having set forth the construction of way station 22, one important point should be noted. Specifically, the dwell time of a car $C_2$ at way station 22 is approximately twice as long as the dwell time of that same car at the other way stations 21, 23 and 24. Since the repairs to the underside of the car take approximately twice as long as the other planned sequences shown herein, it has been found at way station 22, in having this double dwell time, readily fits into the programmed dwell time herein illustrated.

Having set forth overall construction of the car repair station in FIG. 1 and the operation of way station 22 in FIGS. 2-6, the construction and operation of the typical gantry G1 and horizontal beam H can now be detailed.

Figure 7:
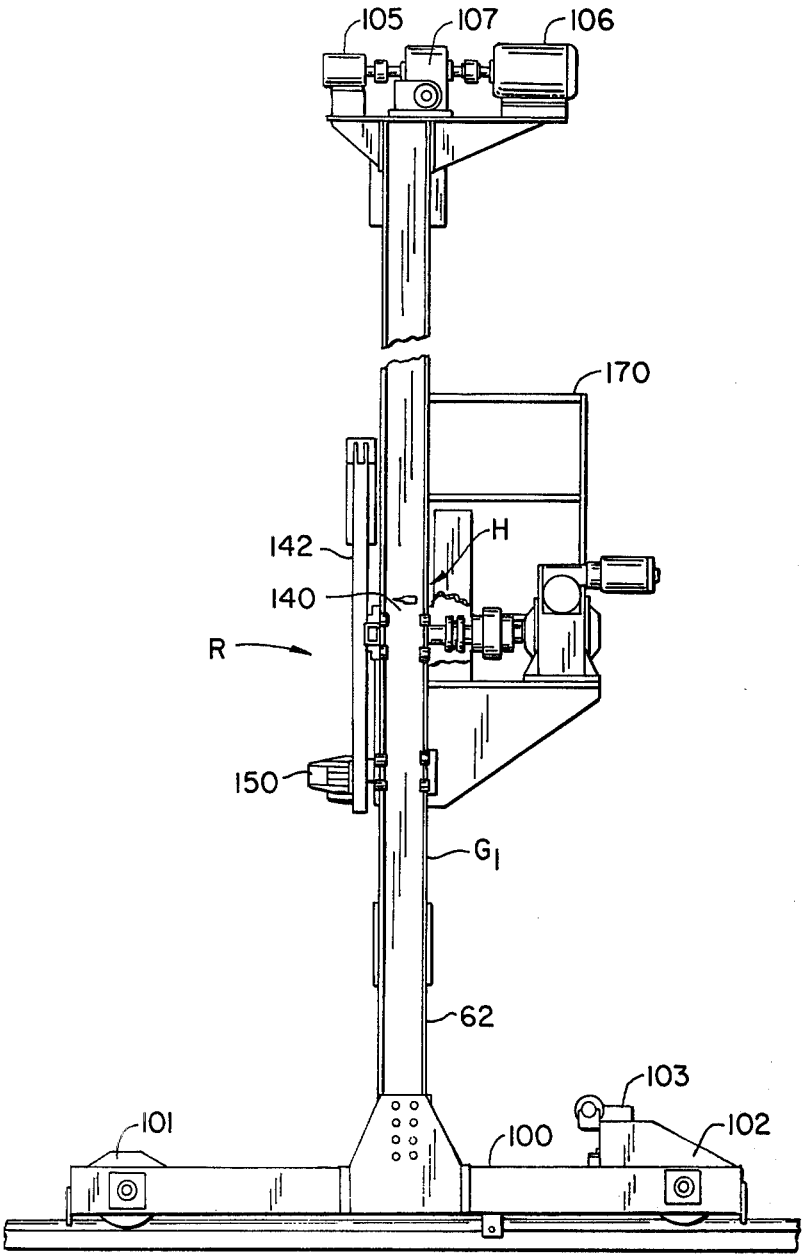
FIG. 7 is a side elevation of one of the gantries, illustrating both the mechanism for raising and lowering the horizontal beam, as well as the car rotation mechanism.
Figure 8:
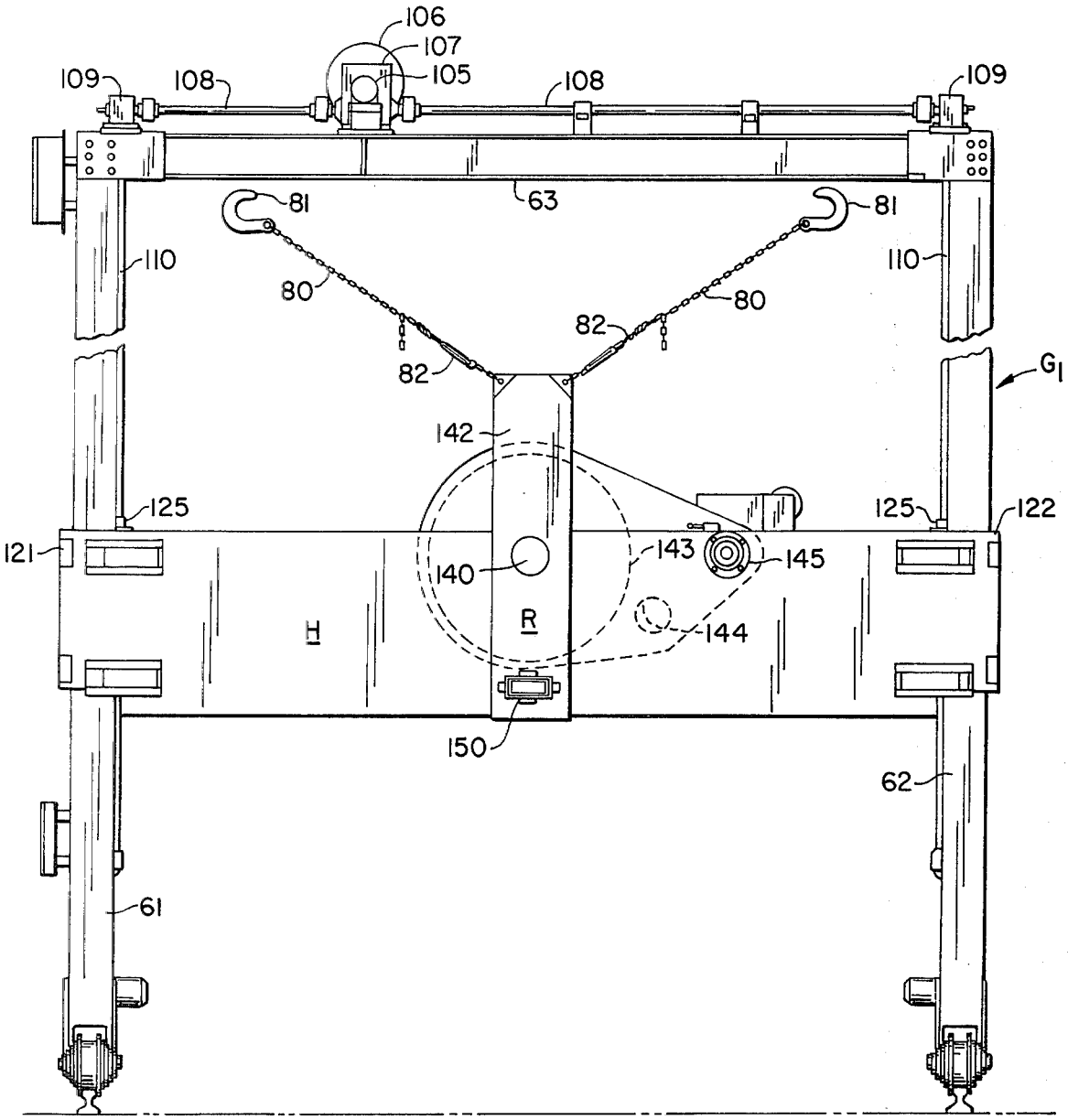
FIG. 8 is an end elevation view of the side elevation of FIG. 7.

Referring to FIGS. 7 and 8, gantry G1 is illustrated having respective vertical members 61, 62 and interconnecting horizontal member 63. Members 61, 62 are permanently attached to the respective ends of horizontal member 62. Overall frame bracing is provided, so that frame collapse does not occur, this bracing, including the depth of the horizontal beam H as it rides upwardly and downwardly on the respective vertical members 61, 62. Each of the vertical members 61, 62 rides on a rail 100. Rail 100 supports paired wheel sets 101, 102. Wheel set 102 is powered by electric motor 103. Naturally, by the expedient of powering motor 103, wheel 102 drives the gantries inwardly and outwardly of way station 22.

Referring to FIG. 7 and then FIG. 8, paired driving motors 105, 106 furnish tortional input to an override clutch 107. When the horizontal beam H has virtually no load, motor 105 through clutch 107, shaft 108, transmissions 109 drive paired screws 110, one screw being mounted in beam 61, the other screw being mounted in beam 62. By providing a screw rider, movement of the lifting beam H upwardly or downwardly in an accelerated mode can be provided.

When the full weight of a railroad car $C_2$ need be lifted, power is supplied by larger motor 106. Motor 106 through override mechanism 107 uncouples motor 105. Slow movement of beam H with great mechanical leverage for lifting of the railroad car body can occur.

Beam H is a horizontal member having sufficient strength to bear the entire weight of car $C_2$ when supported at its respective ends. It includes I-beam riders 121 for beam 61 and 122 for beam 62. The configuration of the I-beam riders can vary. However, it is important that the riders grasp the respective beams along the full depth of beam H. This grasping permits beam H at all positions between the vertical members 61, 62 to impart a bracing function to the U-shaped gantry $G_1$.

A screw jack rider 125 fits at each end of the beam H. Screw jack rider 125 enables beam H to follow rotation of the respective screws 110. As is conventional, rotation of the screws in a first direction causes upward beam movement of beam H; rotation of screws 110 in the opposite direction causes downward movement of beam H.

Having described the function of beam H, the bell crank R can now be set forth.

Referring to FIG. 7 and 8, bell crank R is rotatably mounted to a shaft 140 by bearings not shown through the medial portion of beam H. At one end of shaft 140 there is mounted a rotating beam 142. At the opposite end of shaft 40 a turning wheel 143 is chain driven by chain 144. Chain 144 is in turn powered by a motor driven socket 145.

A protruding male coupler pocket member 150 protrudes from the lowermost portion of bar 142. It is the eccentric member with respect to the center of rotation 140 of bell crank R and provides the bell crank mounting of the coupler pocket to the lifting beam H.

The upper portion of bar 142 has fastened thereto first and second ratchet chains 80. As is common in the art of chains and ratches, the chain at its outward end includes hooks 81 and ratchet mechanism at the inward end in 82. By the simple expedient of placing hooks 81 to a portion of the railroad car undergoing repair and tightening at ratches 82, firm fastening of the railroad car to the paired gantries occurs.

It should be noted that rotation of the car could in fact be supplied by any matter of means. For example, both bell cranks R could be merely rotatably mounted if rotation of the car is being supplied by grasping the outer surface of the car in any way. Preferably, one gantry $G_1$ is built with its own motor drive; the remaining gantry $G_2$ and its bell crank R is merely an idler. The gantry $G_2$ would typically not be provided with a drive.

Typically, and for safety's sake, safety rails 170 are fastened at each car end. These respective safety rails 170 enable workmen to ride beam H and effect the fastening of chains 80, both without danger of falling from the appartus disclosed.

Figure 9:
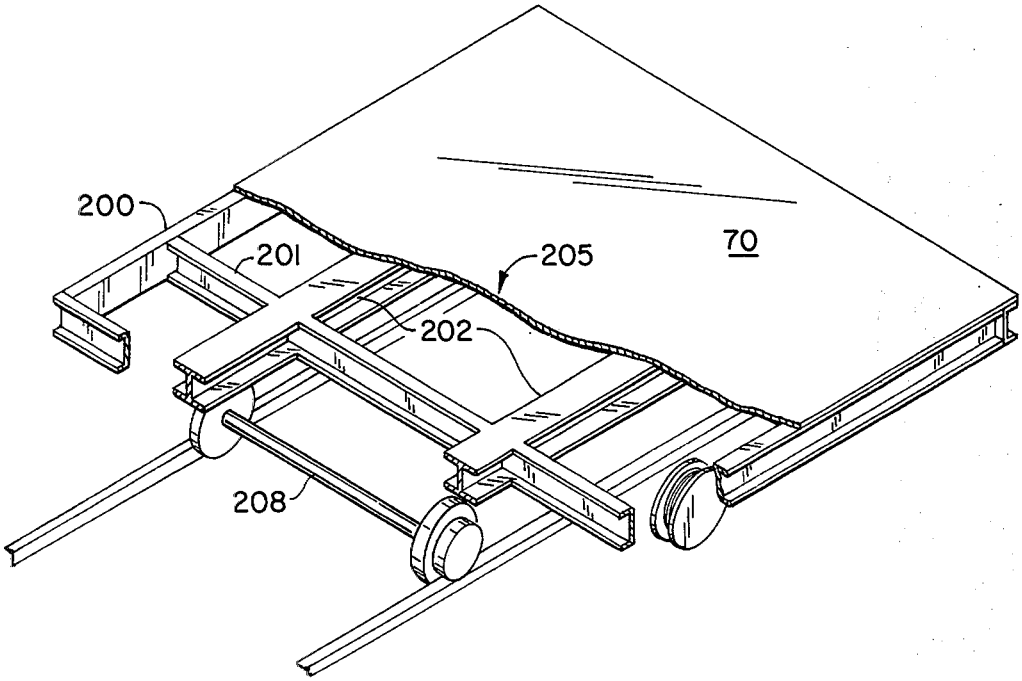
FIG. 9 is a perspective view of one of the platforms for conveying the apparatus away from the car lifting and rotating mechanism.

Referring finally to FIG. 9, a typical platform 70 for conveyance of the car on its side away from the medial portion of way station 22 is illustrated. Typically, an I-beam frame 200 with suitable cross members 201 and longitudinal members 202 have thereon a car receiving surface 205. The car is transported on rails (not shown in FIG. 9) by wheel sets 208. Typically, one wheel set is powered (by apparatus not shown), so that automated movement of a supported railcar can occur.

It will be understood that the disclosed invention includes both an apparatus and process for the repair of railcars. For example, by providing the U-shaped gantries, which define substantially no obstruction between tracks B on the floor of the shop and the top of a railcar, continuous movement of the cars through way station 22 can be provided by the steps of confronting the car ends with the eccentric cranks, effecting rotation and laying the cars on their side on platforms, which platforms are preferably moveable, ready movement of a car into and out of a railcar repair station can occur. By the expedient of locating one railcar repair station to one side of the lifting and rotating mechanism and another railcar repair station to the other side of the lifting and rotating mechanism at least two cars at a time can be handled in the disclosed repair station. Further, by the expedient of providing for nonpendulous suspension of the railcar and exact coupler registration of the coupler pockets over track B, registry of a repaired car to refurbished trucks is simple process.

It will be appreciated that modification can be made to the disclosed car repair station, all without parting from the spirit and scope of this invention.

What is claimed is:

1. A railroad car repair station to lift and rotate a railroad car located at said car repair station comprising in combination: a track passing longitudinally of said car repair station; first and second gantries located at each end of said car repair station, at least one of said gantries including means for mounting said gantry for ground supported rolling movement substantially parallel to said track from a position removed from the ends of said car to a position confronted to the ends of said car; each gantry further including a substantially horizontal beam member attached at least one end to said gantry, said beam having an upward and downward movement on said gantries, said upward movement defining an unobstructed interval between said track and said beam member sufficient to permit the unobstructed passage of said car under said beam on said track, each said horizontal beam including means for grasping said car at an end of a car and means for rotating said car when said car is lifted between said grasping means and beam; whereby when said car is fastened to said beam and lifted by said beam, said car can be rotated, said means for grasping a car for rotating includes a bell crank mounted for rotation to said horizontal beam and having a male eccentric member for being received by the female coupler concavity of said car.

2. A railroad car repair station to lift and rotate a railroad car located at said car repair station comprising in combination: a track passing longitudinally of said car repair station; first and second gantries located at each end of said car repair station, at least one of said gantries including means for mounting said gantry for ground supported rolling movement substantially parallel to said track from a position removed from the ends of said car to a position confronted to the ends of said car; each gantry further including a substantially horizontal beam member attached at least one end to said gantry, said beam having an upward and downward movement on said gantries, said upward movement defining an unobstructed interval between said track and said beam member sufficient to permit the unobstructed passage of said car under said beam on said track, each said horizontal beam including means for grasping said car at an end of a car and means for rotating said car when said car is lifted between said grasping means and beam; whereby when said car is fastened to said beam and lifted by said beam, said car can be rotated, and further including first and second tracks passing transversely of said car repair station and crossing said car repair station; respective first and second platforms mounted to said tracks; said platforms moveable under said car when lifted by said gantry for receiving and supporting said car and moving said car away from said track passing longitudinally of said car repair station.

3. A process for lifting and rotating a railroad car for repair from its rail trucks on a track comprising the steps of: providing pair gantries; providing at least one of said paired gantries with supported movement along the length of said car from the ground; providing a lifting beam which can be raised and lowered from each said gantry, when lifting beam in the raised position permits the unobstructed passage of said car on said trucks under said beam; providing means for grasping said car at an end from each lifting beam when confronted to the end of said car; providing means for rotating said car when lifted by said grasping means to permit simultaneous rotation of said car end on each said lifting beam; disconnecting the trucks to permit said car to be lifted free of said trucks; passing said car to a position between said gantries, said car passing under one of said lifting beams; confronting said gantries to said car ends; lowering said beams; attaching said grasping means to each car end; lifting said car; rotating said car; providing at least one moveable platform moveable to a position underlying said car between said gantries; and placing said car on said platform for movement away from a position between said gantries.

* * * * *